US012145777B1

(12) United States Patent
Tages et al.

(10) Patent No.: US 12,145,777 B1
(45) Date of Patent: Nov. 19, 2024

(54) CONTAINER WITH LOCKING LID

(71) Applicant: Buddy Box, LLC, Weston, FL (US)

(72) Inventors: Fernando Tages, Coral Springs, FL (US); Harold Scot Goradesky, Plantation, FL (US)

(73) Assignee: Buddy Box, LLC, Weston, FL (US)

( * ) Notice: Subject to any disclaimer, the term of this patent is extended or adjusted under 35 U.S.C. 154(b) by 0 days.

(21) Appl. No.: 18/440,326

(22) Filed: Feb. 13, 2024

Related U.S. Application Data

(60) Provisional application No. 63/498,589, filed on Apr. 27, 2023.

(51) Int. Cl.
*B65D 43/16* (2006.01)
*B65D 25/04* (2006.01)

(52) U.S. Cl.
CPC ..... *B65D 43/162* (2013.01); *B65D 25/04* (2013.01); *B65D 2543/00648* (2013.01); *B65D 2543/00759* (2013.01)

(58) Field of Classification Search
CPC ..... A45D 2040/227; A45D 2040/223; B65D 2215/08; B65D 2251/1058; B65D 2251/105; B65D 2251/1091; B65D 2543/00546
See application file for complete search history.

(56) References Cited

U.S. PATENT DOCUMENTS 3,954,179 A * 5/1976 Warmath ..... B65D 43/162 220/838
4,236,653 A * 12/1980 Gach ..... B65D 50/045 222/543
4,257,537 A * 3/1981 Uhlig ..... B65D 50/045 222/561
4,412,616 A * 11/1983 Williams ..... B25H 3/022 220/255
5,683,016 A * 11/1997 Santagiuliana .... B65D 47/0814 215/237
5,730,313 A * 3/1998 Hayes ..... B65D 1/36 220/526
5,887,736 A * 3/1999 Mar ..... B65D 50/045 220/326
6,824,006 B2 * 11/2004 Lambelet, Jr. ..... B65D 50/04 16/361
2020/0010250 A1 * 1/2020 Herling ..... B65D 47/066

* cited by examiner

*Primary Examiner* — Mollie Impink
(74) *Attorney, Agent, or Firm* — Weisberg I.P. Law, P.A.

(57) ABSTRACT

A container is provided. The container comprises a container body, at least one compartment, a body tab, and a protrusion. The container body has at least one lid that is releasably securable to the container body and movable. The at least one lid has a peripheral wall, a hinge side wall, and a base wall coupled to the peripheral wall and a lid tab secured to one or both of the base wall and the interior of the peripheral wall. The lid tab is releasably mateable with the body tab in the closed position and a hinge side wall and a living hinge disposed proximate the hinge side wall. A moving hinge includes a first portion of the moving hinge which is secured to the second side wall of the container body and the second portion of the moving hinge which is secured to the living hinge.

20 Claims, 12 Drawing Sheets

CONTAINER WITH LOCKING LID

CROSS-REFERENCE TO RELATED APPLICATIONS

This application is related to and claims priority to U.S. Provisional Patent Application Ser. No. 63/498,589, filed Apr. 27, 2023, entitled CONTAINER WITH LOCKING LID, the entirety of which is incorporated herein by reference.

TECHNICAL FIELD

This disclosure relates to a method and system for a locking container lid, and in particular to a locking container lid having a living and moving hinge that allows one-handed operation.

INTRODUCTION

Containers are used to store many different types of materials. In many situations the materials to be held within the container must be secured in such a way that children are not able to easily open the lid to access the contents. In some known locking lid/container arrangements, the container cap is arranged such that threads locking the cap to the container cannot be rotated unless a downward force is applied to the cap while rotating the cap. In other cases, tabs on the exterior of the threaded cap must be squeezed inward or pried outward to clear corresponding tabs on container as the cap is rotated or pried upward. Such arrangements disadvantageously require two hands to remove the cap. In many cases, the cap and the container are two separate pieces such that the cap can be misplaced, dropped and lost, etc. Such arrangements also require expensive and complex tooling owing to have to fabricate multiple pieces for the cap, container, etc.

SUMMARY

Some embodiments advantageously provide a method and system for a locking container lid that allows one-handed operation and that includes a hinged lid. Such an arrangement also allows fabrication of the container body and lid as a single piece.

BRIEF DESCRIPTION OF THE DRAWINGS

A more complete understanding of embodiments described herein, and the attendant advantages and features thereof, will be more readily understood by reference to the following detailed description when considered in conjunction with the accompanying drawings wherein.

DETAILED DESCRIPTION

Figure 1:
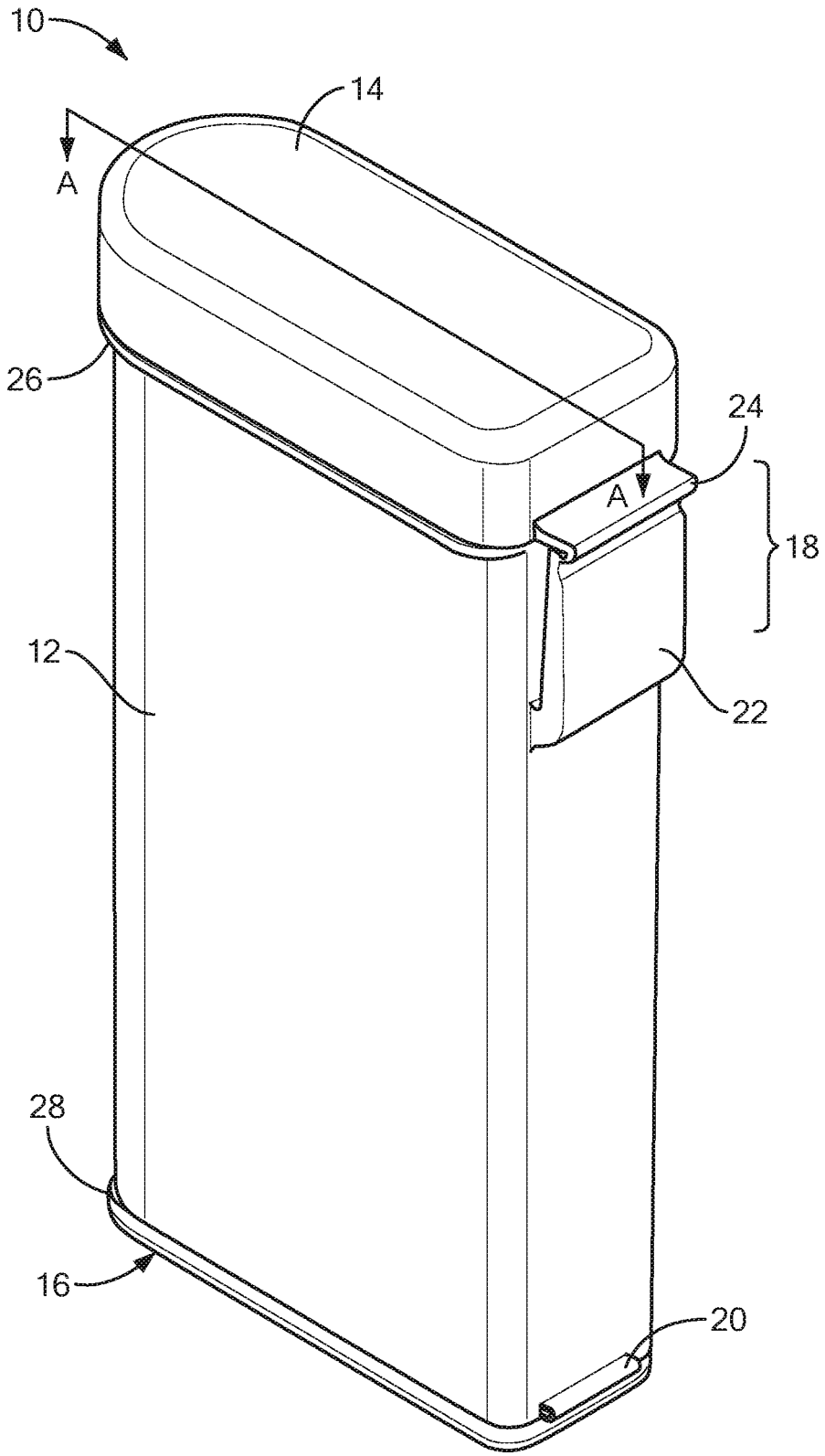
FIG. 1 is a top perspective view of a container having closed lids constructed in accordance with the principles of the present invention.

Before describing in detail exemplary embodiments, it is noted that the embodiments reside primarily in combinations of apparatus components and processing steps related to a locking lid and a container having a locking lid. Accordingly, the system and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements. The terminology used herein is for the purpose of describing particular embodiments only and is not intended to be limiting of the concepts described herein. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

In embodiments described herein, the joining term, "in communication with" and the like, may be used to indicate electrical or data communication, which may be accomplished by physical contact, induction, electromagnetic radiation, radio signaling, infrared signaling or optical signaling, for example. One having ordinary skill in the art will appreciate that multiple components may interoperate and modifications and variations are possible of achieving the electrical and data communication.

Referring now to the drawing figures in which like reference designators refer to like elements, there is shown in FIG. 1 a container 10. Container 10 includes container body 12, top lid 14, bottom lid 16, top hinge 18 and bottom hinge 20. In some embodiments, container body 12, top lid 14, bottom lid 16, top hinge 18 and bottom hinge 20 can be formed as unitary structure, such as molded from a suitable polymer. Hinge 18, the operation of which is discussed in detail below, may include a moving hinge portion 22 that provides a resilient spring-like substantially lateral (toward and away from container body 12) action, and a living hinge portion 24 coupled to moving hinge portion 22 in which living hinge portion 24 allows lid 14 to be pivotably rotatable from a first locked position to a second unlocked position at the top (first) end 26 of container body 12. It is noted that the shape of lids 14, 16 and the shape of container body 12 shown and described herein are used to aid understanding of the inventive locking lid and how a container with such a locking lid might be embodied. In other words, it is contemplated that other container body 12 and lid 14, 16 shapes can be used. As long as lid 14 and container body 12 include the structural elements discussed below with respect to supporting the locking and unlocking functions, the shape of general shape of container body 12 and lid 14, 16 is not relevant. Further, although container body 12 is described as having a number of compartments, embodiments are not limited to a particular arrangement. Container 10 can have any number of compartments based on the particular implementation need. Further, some embodiments may not include or need bottom lid 16.

Container body 12 forms an inner volume which may be a single compartment or have one or more dividing elements, i.e., walls, to form multiple compartments. Bottom lid 16 is rotatably and releasably couplable to container body 12 at the bottom (second) end 28 of container body 12 in which top end 26 is on the opposite end of container body 12 with respect to second end 28.

Figure 2:
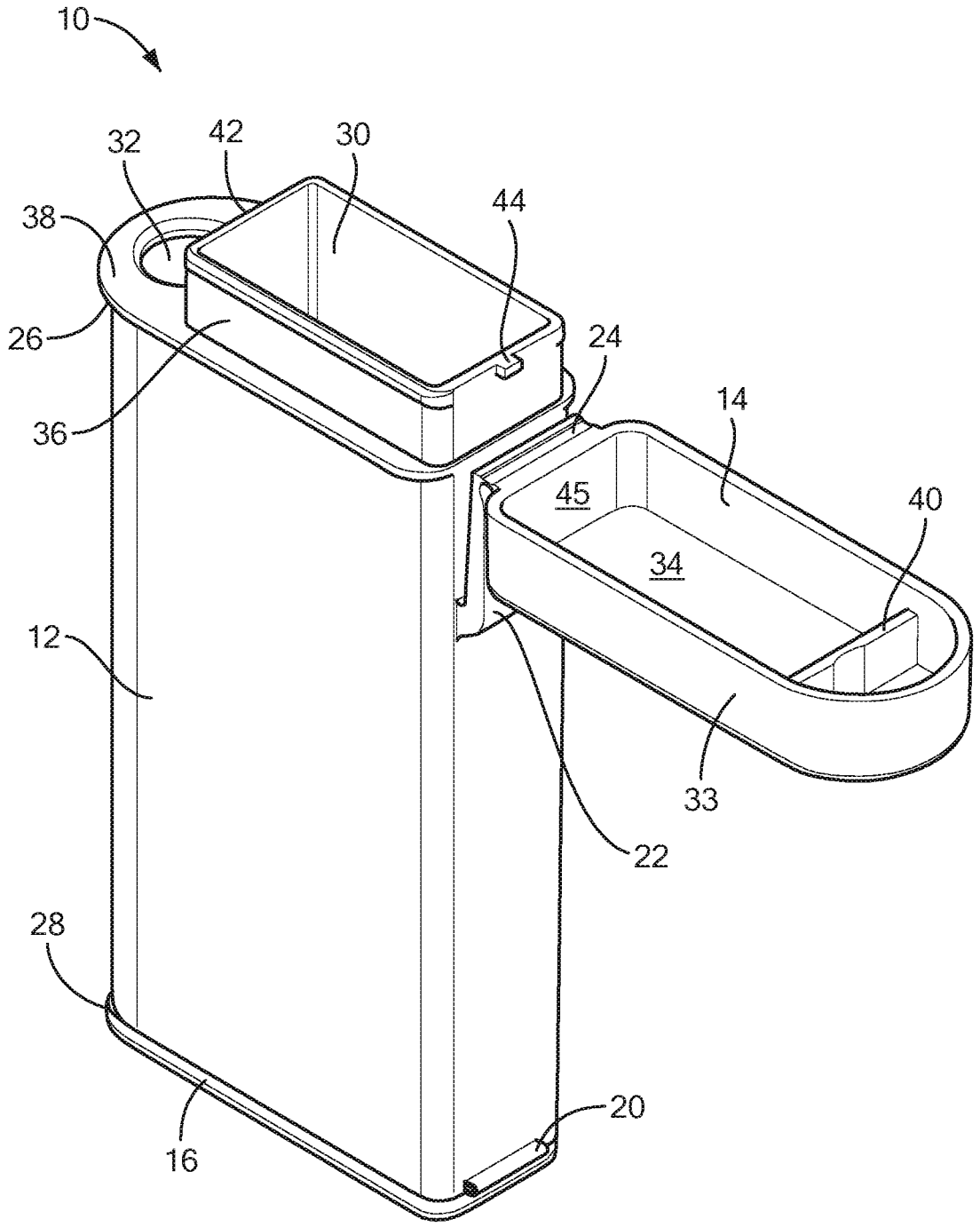
FIG. 2 is a top perspective view of the container having an open top lid and closed bottom lid constructed in accordance with the principles of the present invention.

FIG. 2 is a top perspective view of container 10 having an open top lid 14 and closed bottom lid 16. Container body 12 may have one or more openings at the top (first) end 26. For example, the embodiment of FIG. 2 shows container body 12 having a first opening 30 which provides access to a first compartment, and a second opening 32 which provides access to a second compartment. In one embodiment, the second compartment can be used to store a smoking pipe (not shown) while the first compartment can be used to store smoking material. Top lid 14 is arranged with a peripheral wall 33 which is coupled at one end (hinge side wall 45) to living hinge 24. Top lid 14 also includes a base wall 34 coupled to peripheral wall 33, thereby forming an inner volume which is arranged, when top lid 14 is in the closed and locked first position, to cover the extended portion 36 of container body 12 that extends above surface 38 through which second opening 32 is provided. The outer edge of surface 38 also acts as an edge shield to inhibit opening by preventing an operator from sliding a finger nail or other object between top lid 14 and container body 12 to try to forcibly open top lid 14.

Top lid 14 also includes lid tab 40, which, as discussed below in detail, is arranged to releasably lockably mate with a corresponding body tab 42 on container body 12 when top lid 14 is in the closed and locked first position. Container body 12 also includes protrusion 44 on the side of extended portion 36 that is on the same side as top hinge 18. Although protrusion 44 is shown on the periphery of extended portion 36 that is adjacent first opening 30, it is understood that protrusion 44 can be positioned lower on extended portion 36, i.e., closer to surface 38. As discussed below, protrusion 44 serves as fulcrum for engagement with hinge side wall 45 of peripheral wall 33.

Figure 3:
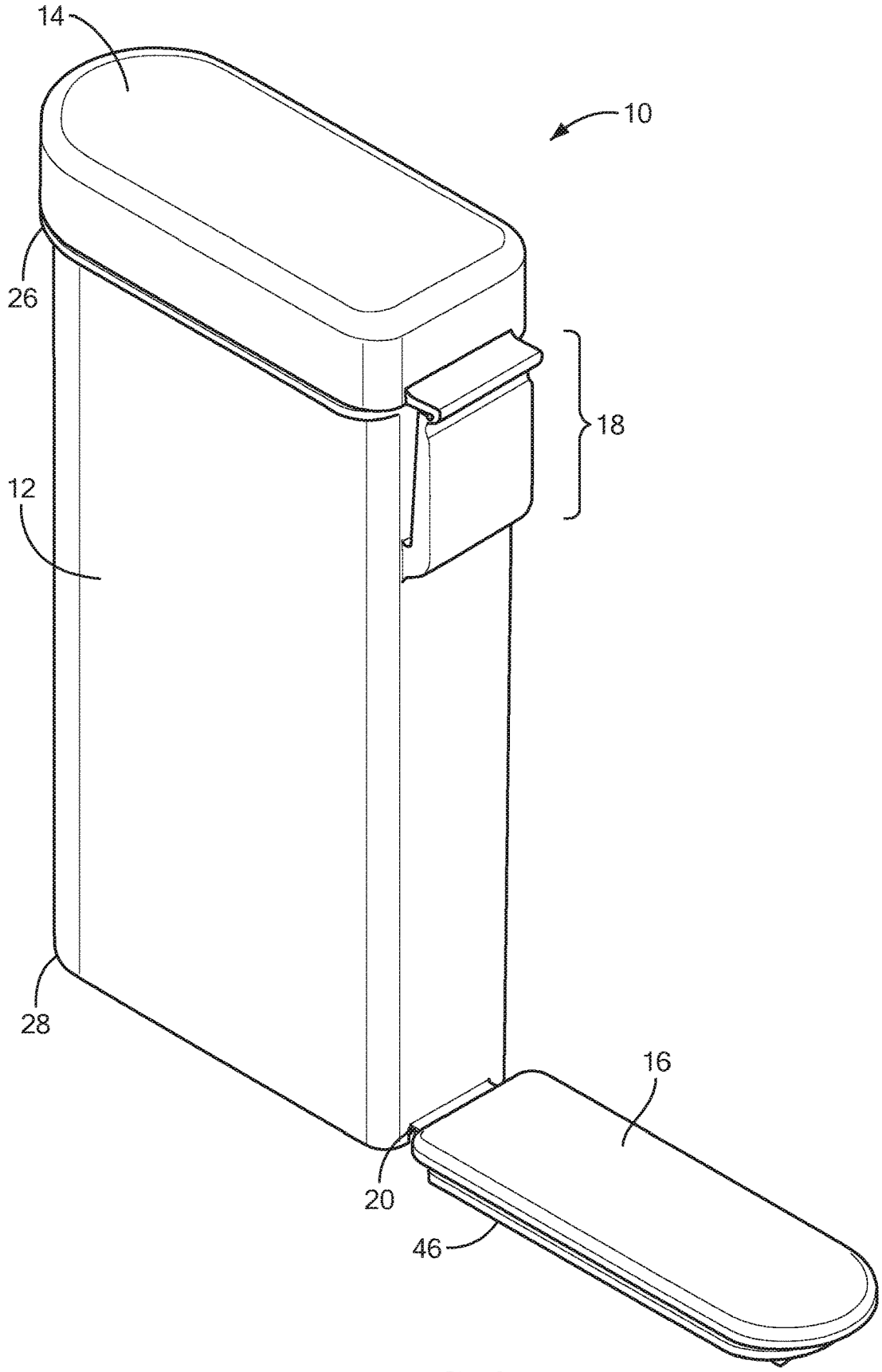
FIG. 3 is a top perspective view of the container having a closed top lid and opened bottom lid constructed in accordance with the principles of the present invention.

FIG. 3 is a top perspective view of container 10 having a closed top lid 14 and opened bottom lid 16. As is seen in FIG. 3, bottom lid 16 is rotated about the pivot point formed by bottom hinge 20 to open. Bottom lid 16 includes ridge 46 inset from the outer periphery of bottom lid 16. Ridge 46 is inset such that it is positioned inside the bottom end 28 of container body 12 to releasably mate with a corresponding ridge (not shown) inside the bottom end 28 of container body 12 when bottom lid 16 is in the closed position to keep bottom lid 16 closed.

Figure 4:
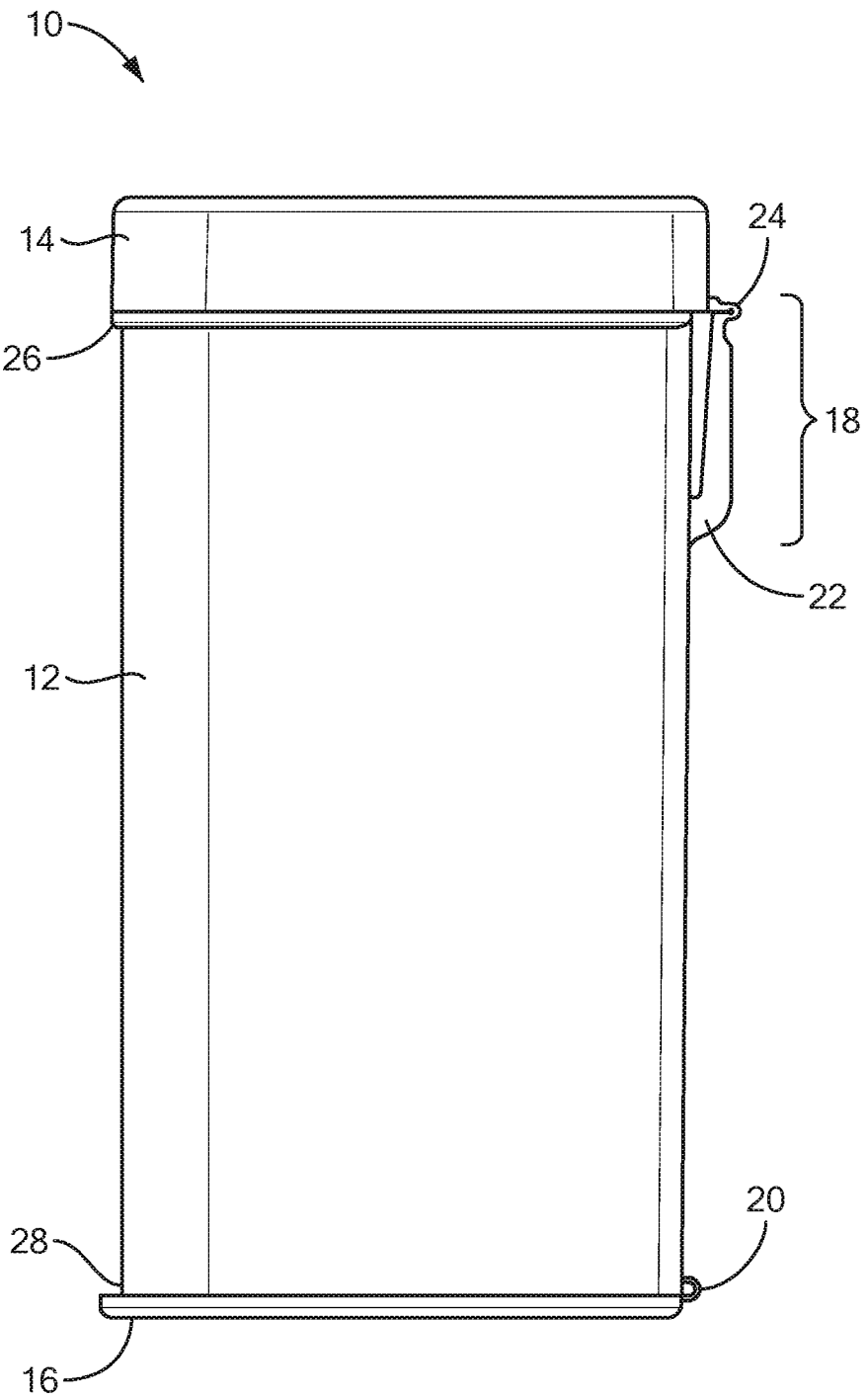
FIG. 4 is a front view of the container having closed lids constructed in accordance with the principles of the present invention.

FIG. 4 is a front view of container 10 having closed top lid 14 and bottom lid 16.

Figure 5:
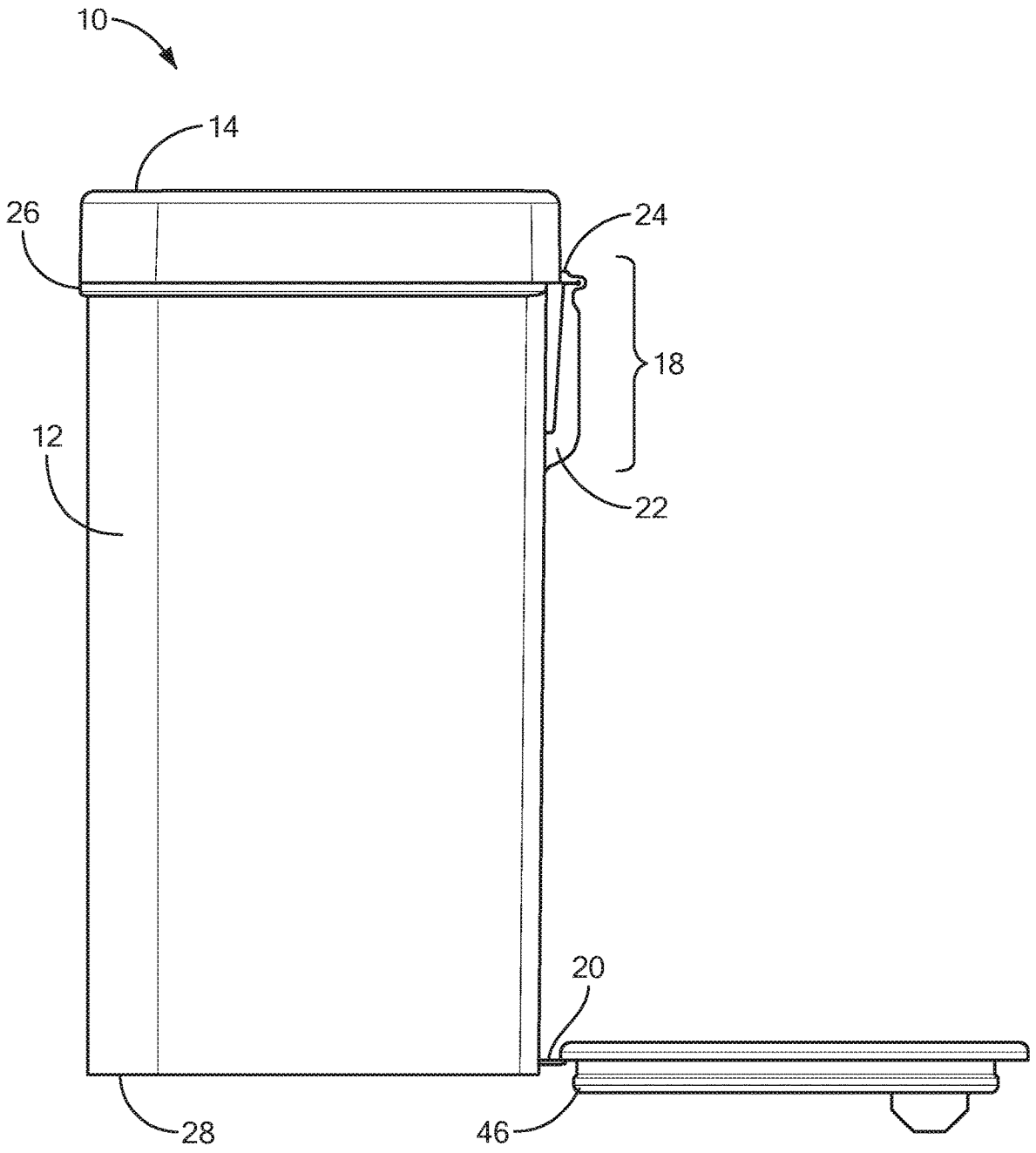
FIG. 5 is a front view of the container having a closed top lid and an open bottom lid constructed in accordance with the principles of the present invention.

FIG. 5 is a front view of container 10 having a closed top lid 14 and an open bottom lid 16.

Figure 6:
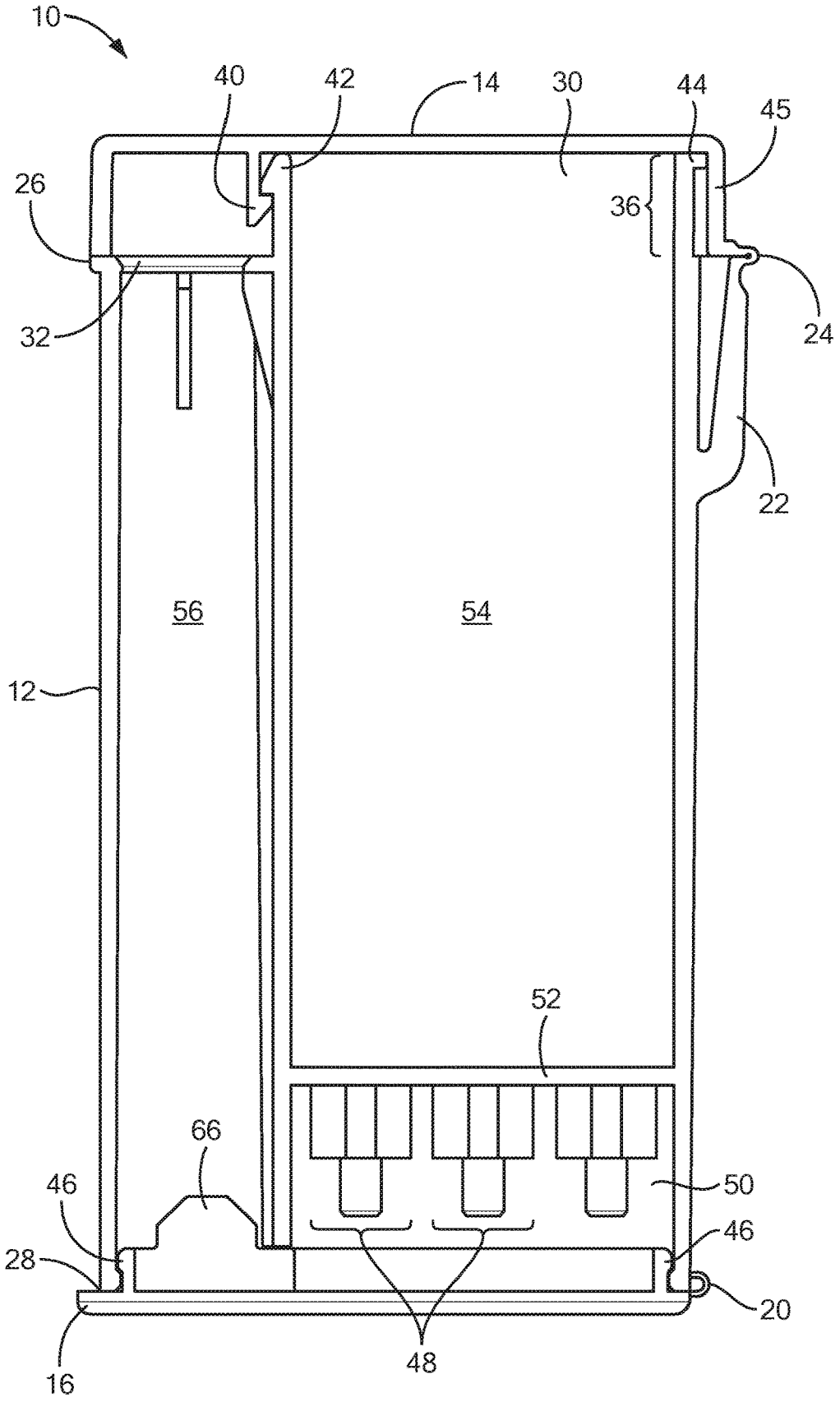
FIG. 6 is a front section view of the container taken through section A-A in FIG. 1 having closed lids constructed in accordance with the principles of the present invention in which the top lid is locked to the container body.

FIG. 6 is a front section view of container 10 taken through section A-A in FIG. 1 having closed top lid 14 and bottom lid 16 in which top lid 14 is releasably locked to container body 12. FIG. 6 shows that, when in the locked first position, lid tab 40 is engaged with body tab 42 to prevent the opening/rotation of top lid 14 with respect to container body 12. Also, because both lid tab 40 and body tab 42 are internal to the sealed container, i.e., inaccessible, when top lid 14 is closed and locked, top lid 14 cannot be opened by an operator by manually manipulating lid tab 40 and body tab 42 or by prying lid tab 40 and body tab 42 apart. Of note, although embodiments described herein show a releasably lockable top lid 14 and a non-lockable bottom lid 16, such is provided for ease of explanation and understanding. It is contemplated that both top lid 14 and bottom lid 16 can be releasably lockable using the same structure as shown and described with respect to top lid 14.

As is also shown in FIG. 6, one or more pipe cleaning elements 48 are positioned within recessed region 50 on container base 52 opposite first compartment 54. As discussed above, first compartment 54 is accessible via first opening 30. FIG. 6 also shows second compartment 56, accessible via second opening 32. Recessed region 50 is accessible when bottom lid 16 is in the opened second position. When opened, pipe cleaning elements 48 are arranged to mate with a corresponding portion of a pipe to clean the pipe bowl.

Figure 7:
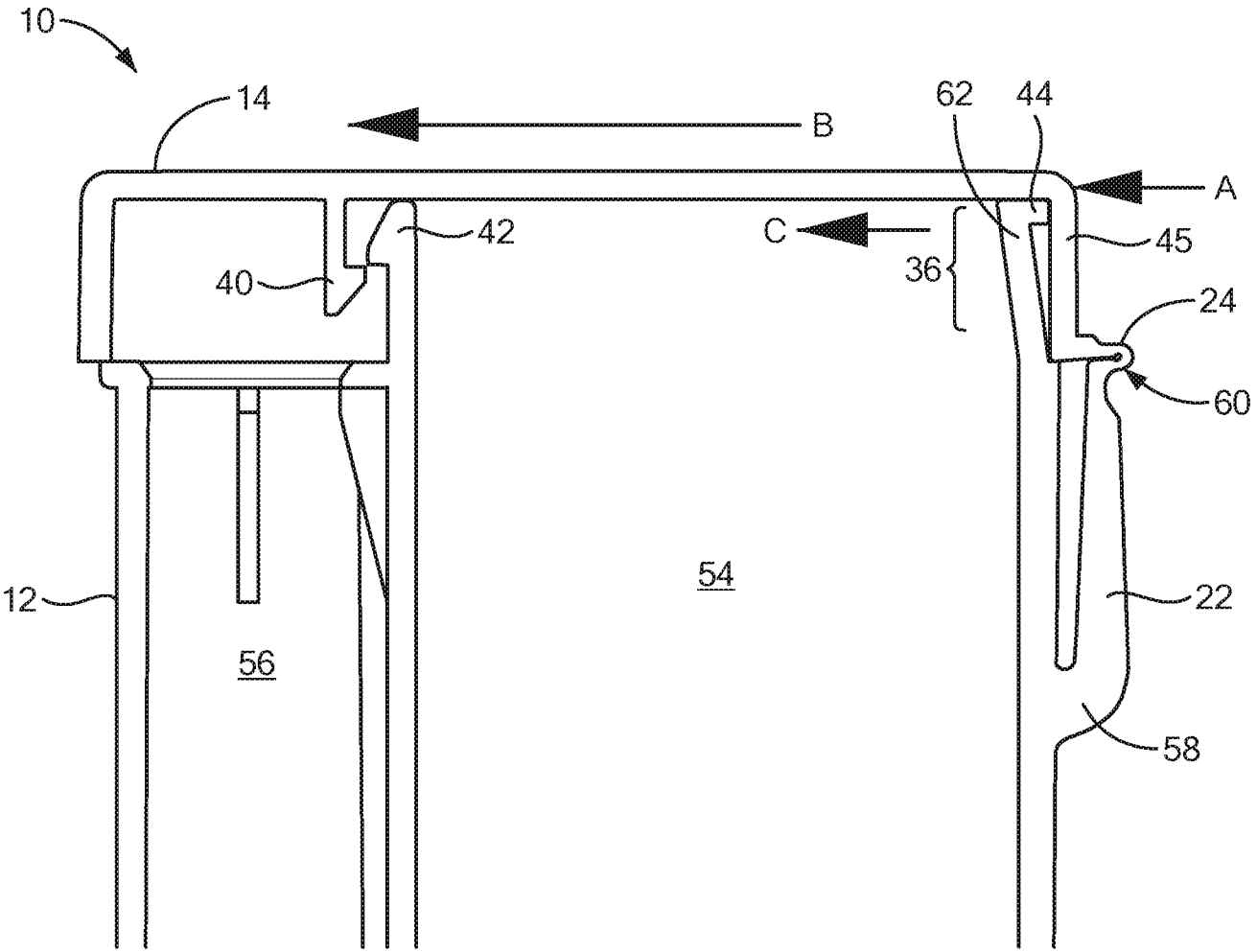
FIG. 7 is a front section view of the locking portion of the container generally taken through section A-A in FIG. 1 as the top lid is moved to an unlocking position.
Figure 8:
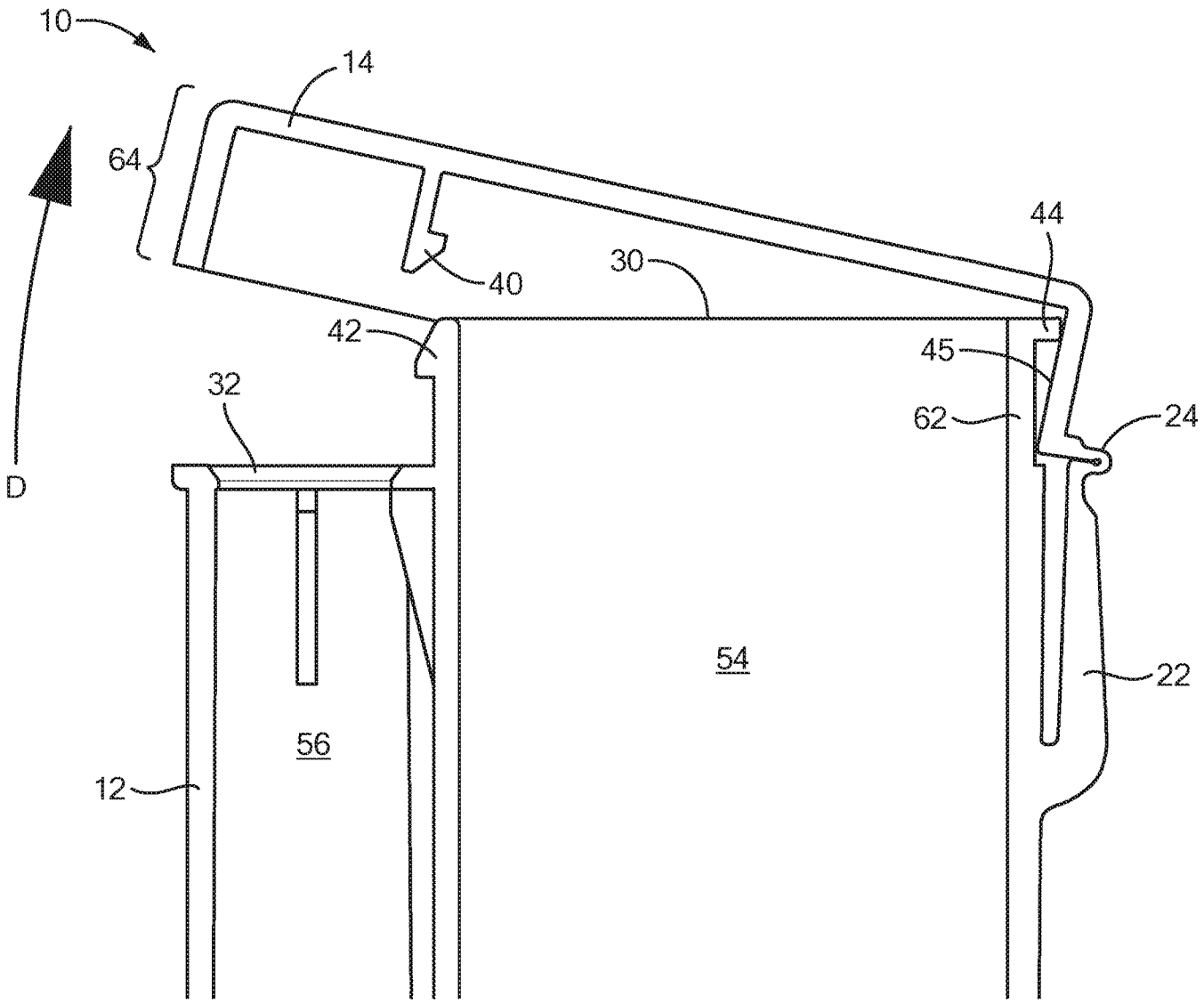
FIG. 8 is a front section view of the locking portion of the container generally taken through section A-A in FIG. 1 as the top unlocked lid is rotated away from the container body.
Figure 9:
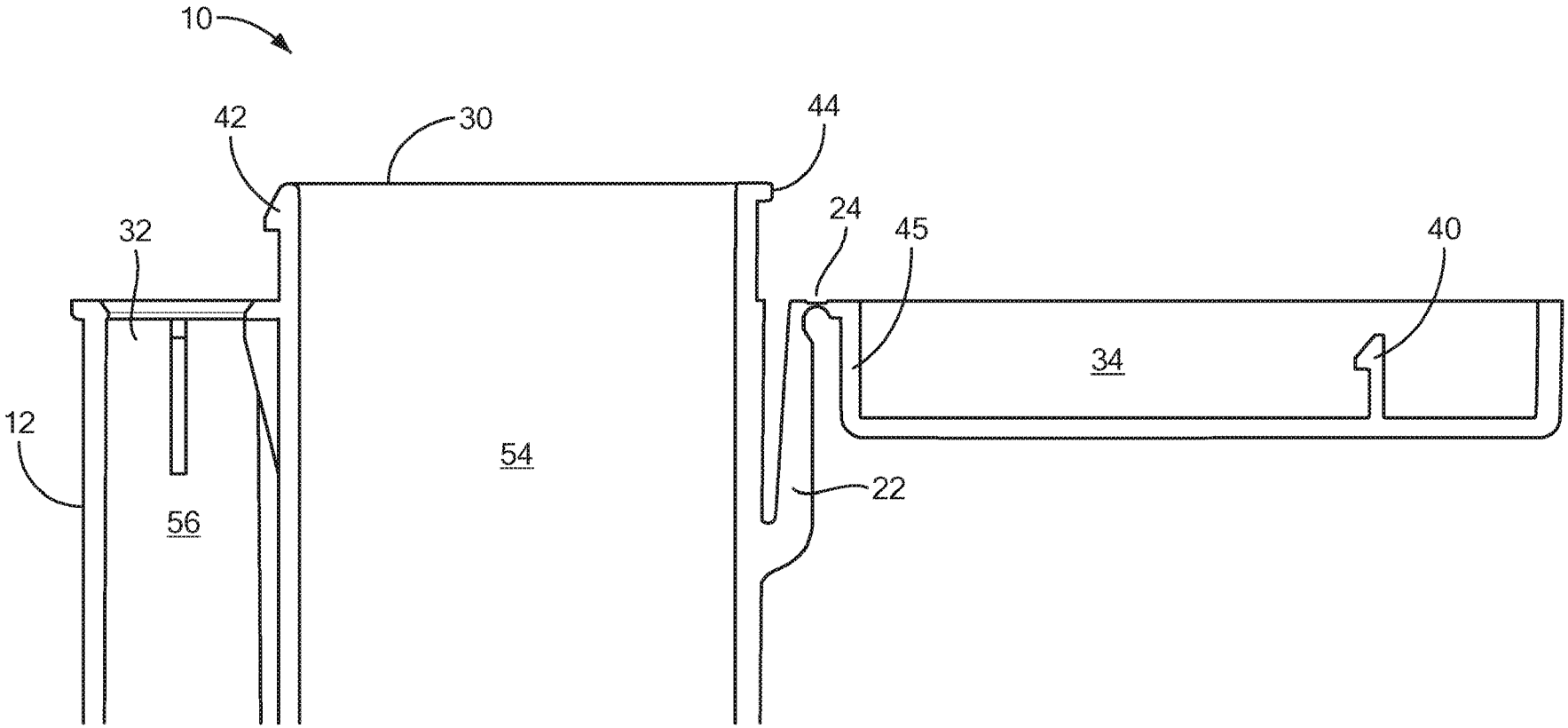
FIG. 9 is a front section view of the locking portion of the container generally taken through section A-A in FIG. 1 as the top unlocked lid is in a fully opened position.

Operation of unlocking and opening top lid 14 is explained with reference to FIGS. 7, 8 and 9. FIG. 7 is a front section view of the locking portion of container 10 as top lid 14 is moved to an unlocking position by separating lid tab 40 from body tab 42. FIG. 8 is a front section view of the locking portion of container 10 generally taken through section A-A in FIG. 1 as top lid 14 is beginning to be rotated away from container body 12. FIG. 9 is a front section view of the locking portion of container 10 generally taken through section A-A in FIG. 1 as the unlocked top lid 14 is in the fully opened (second) position, allowing access to first compartment 54 and second compartment 56.

Referring now to FIG. 7, the initial step in opening top lid 14 is pressing hinge side wall 45 of top lid 14 inward, i.e., toward first compartment 54, at point A and in the direction of the arrow corresponding to point A. The force causes moving hinge 22 to likewise resiliently pivot inward toward first compartment 54 about point 58 at junction 60 of moving hinge 22 and living hinge 24. The result is that top lid 14 slides laterally along container body 12 in direction B such that lid tab 40 is disengaged from body tab 42. Protrusion 44 engages with hinge side wall 45, causing the corresponding part of container body wall 62 to flex inward toward first compartment 54 in direction C. Container body 12 is made of a resilient polymer such that, when pressure is no longer applied by the user at point A, protrusion 44 springs back in the opposite direction to direction C, causing lid tab 40 to reengage with body tab 42. It is noted that an operator can single handedly hold container 10 in the operator's hand and, using a thumb, press point A to release lid tab 40 from body tab 42.

Referring now to FIG. 8 and continuing from the point shown in FIG. 7, once lid tab 40 is released from body tab 42, top lid 14 can be rotated in direction D to pivot about living hinge 24. Rotation along direction D occurs automatically once lid tab 40 is released from body tab 42 by the rotational force created by protrusion 44 and the spring force of container body wall 62. Further rotation along direction D can be accomplished by the operator using the same hand as used to release top lid 14 from the locked position as described with respect to FIG. 7 and by using the pointer or index finger or thumb of the same hand positioned at the end region or side region of peripheral wall 33 of top lid 14. As is shown in FIG. 8, once opened and the operator is no longer pressing on hinge side wall 45, moving hinge 22 returns to its resting, i.e., biased, position, and container body wall 62 returns to its resting, i.e., unflexed, position.

Referring now to FIG. 9 and continuing from the point shown in FIG. 8, rotating top lid 14 in direction D (FIG. 8) allows top lid 14 to be fully opened to the second position, thereby providing access to first compartment 54 and second compartment 56 via openings, 30 and 32, respectively. As is shown in FIG. 9, once opened and the operator is no longer pressing on hinge side wall 45, moving hinge 22 returns to its resting, i.e., biased, position, and container body wall 62 returns to its resting, i.e., unflexed, position. Closing top lid 14 is accomplished by rotating top lid about living hinge 24 in the direction opposite to direction D (FIG. 8) until lid tab 40 reengages and mates with body tab 42.

It is noted that the actions described with reference to FIGS. 7-9 are not easily discernable such that children and others who should not have access to the contents of container 10 cannot readily open top lid 14. It is also noted that by providing living hinge 24 on a moving platform via moving hinge 22 that acts as a spring, i.e., a living hinge on a "spring", container 10 can be molded as a single piece while still proving the axes of motion needed to unlock top lid 14 and rotate top lid 14 to the opened (second) position. Further, the use of protrusion 44 as a fulcrum in combination with the resilient container body wall 62 creates a rotational force that allows top lid 14 to rotate at least part way in direction D (FIG. 8).

Figure 10:
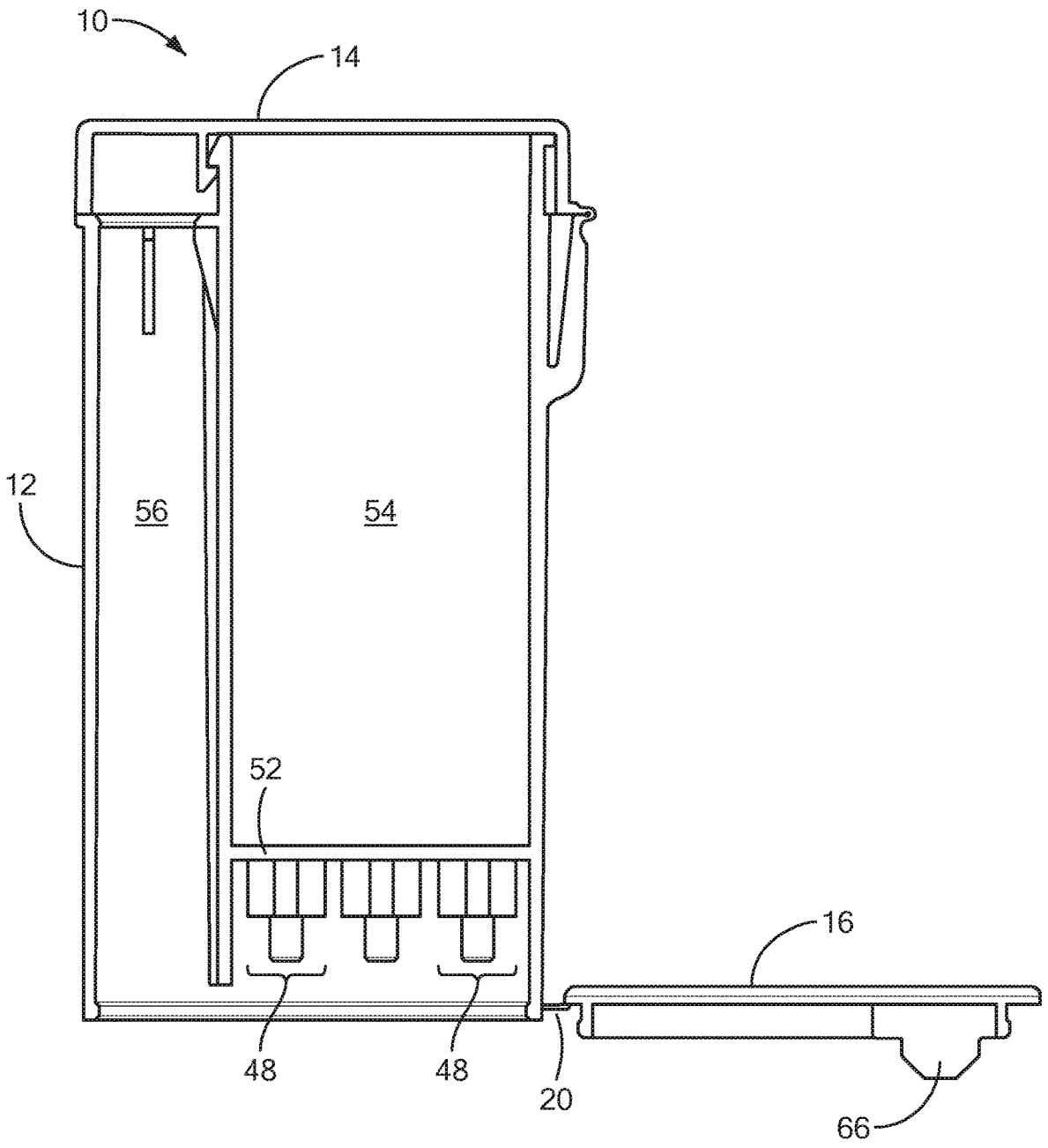
FIG. 10 is a front section view of the container generally taken through section A-A in FIG. 1 constructed in accordance with the principles of the present invention in which the top lid is locked to the container body and the bottom lid is opened.

FIG. 10 is a front section view of container 10 generally taken through section A-A in FIG. 1 in which top lid 14 is locked to container body 12 and bottom lid 16 is opened. Bottom lid 16 also include plateau 66 on the side of bottom lid 16 that faces second compartment 56 when bottom lid 16 is closed. Plateau 66 is arranged to engage with a pipe inserted into compartment 56 to retain the pipe and restrict movement of the pipe within compartment 56.

Figure 11:
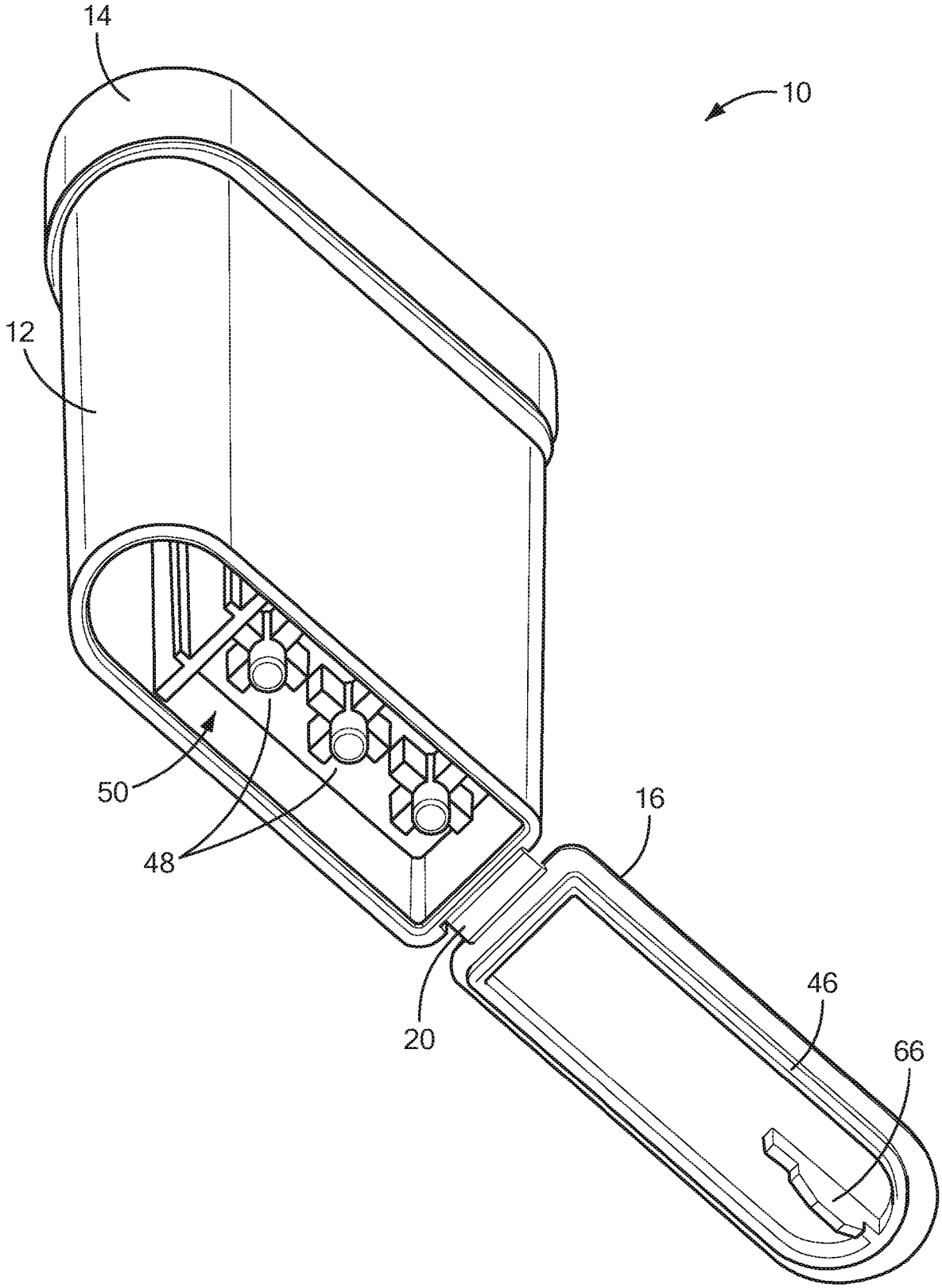
FIG. 11 is a bottom perspective view of the container constructed in accordance with the principles of the present invention having a closed top lid and open bottom lid.

FIG. 11 is a bottom perspective view of container 10 having a closed top lid 14 and open bottom lid 16.

Figure 12:
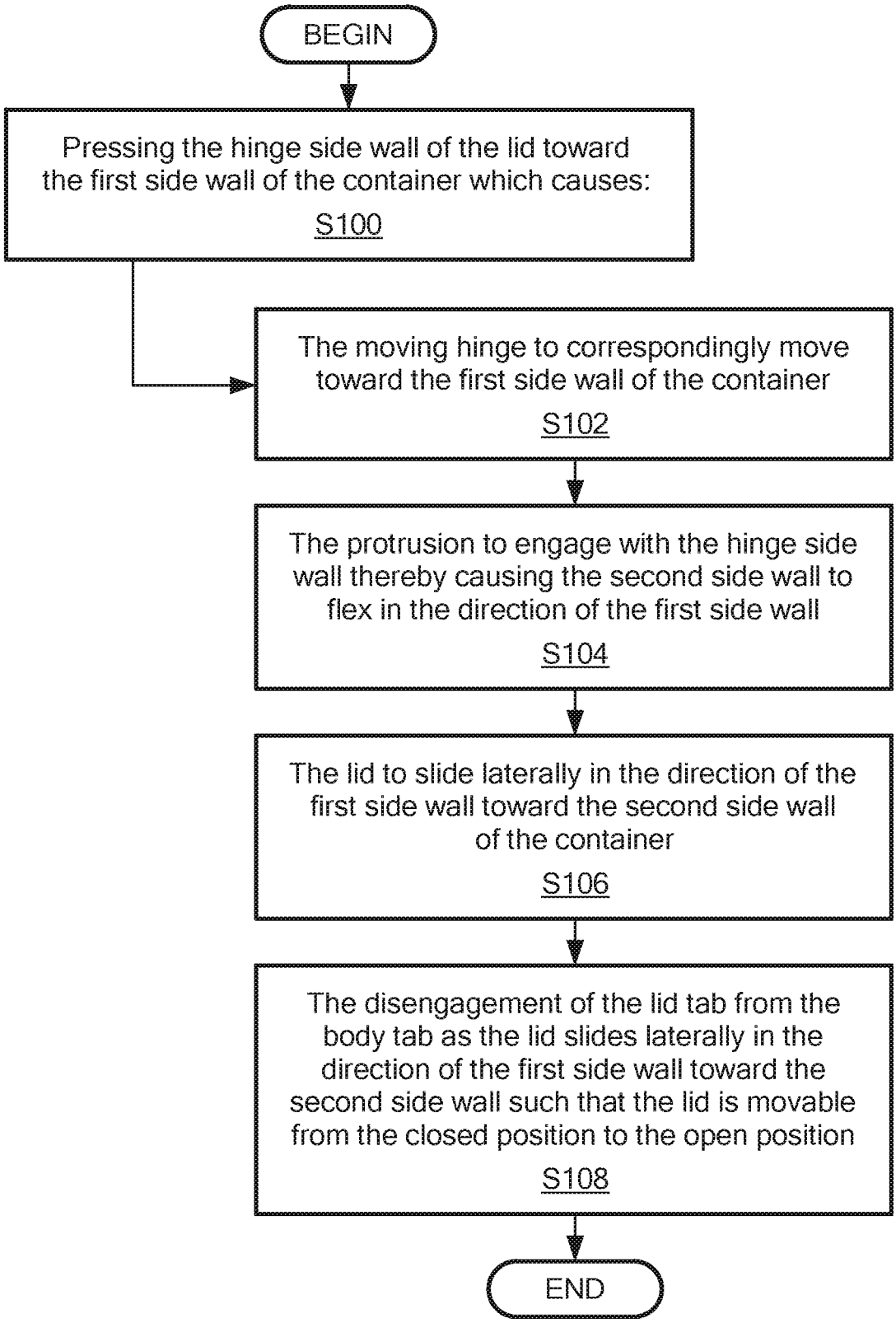
FIG. 12 is a flow chart of an example method of opening a lid that is releasably secured to a container body.

FIG. 12 is a flow chart of an example method of opening a lid 14 that is releasably secured to a container body 12 of an example container 10, the lid 14 being moveable from a closed position to an open position, the container 10 has the container body 12, the lid 14, a living hinge 24 and a moving hinge 22. The container body 12 has a first end, a second end opposite the first end, a first side wall, and a second side wall opposite the first side wall, at least one compartment 54 disposed between the first side wall and the second side wall, a body tab 42 disposed proximate the first end, and a protrusion 44 disposed proximate the first end on the second side wall. The lid 14 includes a peripheral wall having an interior and an exterior and a hinge side wall 45, and a base wall coupled to the peripheral wall, a lid tab 40 secured to one or both of the base wall and the interior of the peripheral wall, the lid tab 40 being releasably mateable with the body tab 42 in the closed position; and a hinge side wall 45 disposed on the exterior of the peripheral wall. The living hinge 24 is disposed proximate the hinge side wall 45. The moving hinge 22 has a first portion and a second portion, the first portion of the moving hinge 22 being secured to the second side wall of the container body and the second portion of the moving hinge 22 being secured to the living hinge 24, in the closed position the protrusion 44 being in contact with the hinge side wall. The method includes pressing the hinge side wall 45 of the lid 14 toward first side wall of the container which causes (S100):

- the moving hinge 22 to correspondingly move toward the first side wall of the container 10 (S102);
- the protrusion 44 to engage with the hinge side wall 45 thereby causing the second side wall to flex in the direction of the first side wall (S104);
- the lid 14 to slide laterally in the direction of the first side wall toward the second side wall of the container (S106); and
- the disengagement of the lid tab 40 from the body tab 42 as the lid 14 slides laterally in the direction of the first side wall toward the second side wall such that the lid 14 is movable from the closed position to the open position (S108).

It will be appreciated by persons skilled in the art that the present embodiments are not limited to what has been particularly shown and described herein above. In addition, unless mention was made above to the contrary, it should be noted that all of the accompanying drawings are not to scale. A variety of modifications and variations are possible in light of the above teachings without departing from the scope of the following claims.

What is claimed:

1. A container, the container comprising:

a container body having a first end, a second end opposite the first end, a first side wall, and a second side wall opposite the first side wall, at least one compartment disposed between the first side wall and the second side wall, the container body having:

a body tab disposed proximate the first end; and a protrusion disposed proximate the first end on the second side wall;

at least one lid that is releasably securable to the container body and movable from a closed position to an open position, the at least one lid having:

a peripheral wall having;

an interior;

an exterior; and a hinge side wall;

a base wall coupled to the peripheral wall;

a lid tab secured to one or both of the base wall and the interior of the peripheral wall, the lid tab being releasably mateable with the body tab in the closed position;

a living hinge disposed proximate the hinge side wall; and a moving hinge having a first portion and a second portion, the first portion of the moving hinge being secured to the second side wall of the container body and the second portion of the moving hinge being secured to the living hinge, in the closed position the protrusion being in contact with the hinge side wall.

2. The container of claim 1, wherein the second side wall has a movable extended portion that is disposed proximate the living hinge, the protrusion being disposed on a periphery of the extended portion.

3. The container of claim 2, where the extended portion is made from a resilient material.

4. The container of claim 3, wherein the protrusion engages with the hinge side wall when the lid is in the closed position.

5. The container of claim 4, wherein the extended portion is flexed inwardly toward the compartment of the container body and the protrusion is in contact with the hinge side wall when the lid is transitioning from the closed position to the open position.

6. The container of claim 5, wherein the extended portion is disposed proximate and is not in contact with the living hinge when the lid is in the open position.

7. The container of claim 1, wherein the moving hinge provides a resilient spring-like substantially lateral action to allow the lid to slide along the first end of the container to engage and disengage the body tab and the lid tab.

8. The container of claim 1, wherein the container further comprises a second lid that is releasably securable to the container body at the second end and is movable from a closed position to an open position, and wherein the second lid is secured to the container with a bottom hinge, the bottom hinge and container body being a unitary structure made from a polymer.

9. The container of claim 8, wherein the second lid has a ridge, the ridge being disposed along an outer periphery of the second lid and wherein the second end of the container is mateable with the ridge of the second lid when the second lid is in the closed position.

10. The container of claim 1, wherein the lid tab and the body tab are inaccessible from an exterior of the lid and the container body when the lid is in the closed position.

11. The container of claim 1, wherein the container body has at least a first compartment and a second compartment.

12. The container of claim 11, wherein the lid tab is positioned within the second compartment with the lid is in the closed position.

13. The container of claim 1, wherein the container body, the at least one lid, the living hinge and the moving hinge are formed as a unitary structure.

14. A lockable lid for a container, the lid being releasably securable to the container and movable from a closed position to an open position, the lockable lid comprising:

a peripheral wall having:

an interior;

an exterior; and a hinge side wall;

a base wall coupled to the peripheral wall;

a lid tab secured to the base wall and the interior of the peripheral wall, the lid tab being releasably lockably mateable with a portion of the container in the closed position;

a living hinge coupled to the hinge side wall; and a moving hinge having a first portion and a second portion, the first portion of the moving hinge being secured to the container and the second portion of the moving hinge being secured to the living hinge.

15. The lid of claim 14, wherein the living hinge is pivotably movable so that the lid can be rotated when the lid is not in the closed position.

16. The lid of claim 15, wherein the living hinge is further coupled with the moving hinge at a junction.

17. The lid of claim 14, wherein the base wall, the peripheral wall, the lid tab, the hinge side wall, the living hinge and the moving hinge are formed as a unitary structure.

18. The lid of claim 14, wherein the lid tab is inaccessible from an exterior of the lid when the lid is in the closed position.

19. A method of opening a lid that is releasably secured to a container body of a container, the lid being moveable from a closed position to an open position, the container having the container body, the lid, a living hinge and a moving hinge;

the container body having:

a first end, a second end opposite the first end, a first side wall, and a second side wall opposite the first side wall, at least one compartment disposed between the first side wall and the second side wall, a body tab disposed proximate the first end, and a protrusion disposed proximate the first end on the second side wall;

the lid comprising:

a peripheral wall having;

an interior;

an exterior; and a hinge side wall a base wall coupled to the peripheral wall;

a lid tab secured to one or both of the base wall and the interior of the peripheral wall, the lid tab being releasably mateable with the body tab in the closed position; and a living hinge disposed proximate the hinge side wall; and a moving hinge having a first portion and a second portion, the first portion of the moving hinge being secured to the second side wall of the container body and the second portion of the moving hinge being secured to the living hinge, in the closed position the protrusion being in contact with the hinge side wall, the method comprising:

pressing the hinge side wall of the lid toward first side wall of the container which causes:

the moving hinge to correspondingly move toward the first side wall of the container;

the protrusion to engage with the hinge side wall thereby causing the second side wall to flex in the direction of the first side wall;

the lid to slide laterally in the direction of the first side wall toward the second side wall of the container; and the disengagement of the lid tab from the body tab as the lid slides laterally in the direction of the first side wall toward the second side wall such that the lid is movable from the closed position to the open position.

20. The method of claim 19, further comprising securing the lid from the open position to the closed position by pressing the lid in a direction of the container body to cause the lid tab and the body tab to mate together to secure the lid to the container body.

* * * * *